US007032691B2

(12) United States Patent
Humphreys

(10) Patent No.: US 7,032,691 B2
(45) Date of Patent: Apr. 25, 2006

(54) UNDERBALANCED WELL DRILLING AND PRODUCTION

(75) Inventor: Gavin Humphreys, Aberdeen (GB)

(73) Assignee: Stena Drilling Ltd., Aberdeen (GB)

( * ) Notice: Subject to any disclaimer, the term of this patent is extended or adjusted under 35 U.S.C. 154(b) by 270 days.

(21) Appl. No.: 10/697,204

(22) Filed: Oct. 30, 2003

(65) Prior Publication Data

US 2005/0092522 A1 May 5, 2005

(51) Int. Cl.
*E21B 7/04* (2006.01)

(52) U.S. Cl. ..... 175/62; 175/50; 175/313

(58) Field of Classification Search ..... 175/62, 175/50, 313, 70, 117.5, 117.6
See application file for complete search history.

(56) References Cited

U.S. PATENT DOCUMENTS

| | | | | |
|---|---|---|---|---|
| 5,848,656 | A | 12/1998 | Moksvold | |
| 6,065,550 | A * | 5/2000 | Gardes | 175/62 |
| 6,216,799 | B1 | 4/2001 | Gonzalez | 175/5 |
| 6,325,159 | B1 * | 12/2001 | Peterman et al. | 175/7 |
| 6,450,262 | B1 | 9/2002 | Regan | 166/350 |
| 6,470,975 | B1 * | 10/2002 | Bourgoyne et al. | 175/57 |
| 6,484,816 | B1 * | 11/2002 | Koederitz | 175/25 |
| 6,571,873 | B1 | 6/2003 | Maus | 166/250.07 |
| 6,904,981 | B1 * | 6/2005 | van Riet | 175/66 |
| 2003/0070840 | A1 | 4/2003 | Boer | |

FOREIGN PATENT DOCUMENTS

| | | |
|---|---|---|
| WO | WO 03/006778 A1 | 1/2003 |
| WO | WO 03/023181 | 3/2003 |

OTHER PUBLICATIONS

Kristian Johnstone, "Training, Control Ensure Success of Offshore Underbalanced Drilling", Drilling Contractor, Jul./Aug. 2000, pp. 38-40.
"Subsea BOP Stack Systems ".

* cited by examiner

*Primary Examiner*—Frank S. Tsay
(74) *Attorney, Agent, or Firm*—Trop, Pruner & Hu, PC

(57) ABSTRACT

Underbalanced production and drilling may be achieved by a system which uses a rotating head coupled to surface blowout preventer stack for fluid flow control. A casing connects these surface components to a subsea shutoff assembly with a pair of ram shear devices to cut off the string to the wellhead. Both the casing and an alternate line may be latched so that they may be released if necessary. The alternate line may provide fluid from the surface to the subsea shutoff assembly for purposes of varying the density of the returning mud. The rotating head may include a rubber packer to prevent upward flow of drilling fluid and production hydrocarbons and, at the same time, provide rotation to the drill string.

51 Claims, 4 Drawing Sheets

UNDERBALANCED WELL DRILLING AND PRODUCTION

BACKGROUND

This invention relates generally to drilling of wells and production from wells.

Generally, wells are drilled in a slightly over-balanced condition where the weight of the drilling fluid used is only slightly over the pore pressure of the rocks being drilled.

Drilling mud is pumped down the drill string to a drill bit and used to lubricate and cool the drill bit and remove drilled cuttings from the hole while it is being drilled. The viscous drilling mud carries the drilled cuttings upwardly on the outside and around the drill string.

In a balanced situation, the density of the mud going downwardly to the drill bit and the mud passing upwardly from the drill bit is substantially the same. This has the benefit of reducing the likelihood of a so-called kick. In a kick situation, the downward pressure of the drilling mud column is not sufficient to balance the pore pressure in the rocks being drilled, for example of gas or other fluid, which is encountered in a formation. As a result, the well may blowout (if an effective blow out preventer (BOP) is not fitted to the well) which is an extremely dangerous condition.

In underbalanced drilling, the aim is to deliberately create the situation described above. Namely, the density or equivalent circulating density of the upwardly returning mud is below the pore pressure of the rock being drilled, causing gas, oil, or water in the rock to enter the well-bore from the rock being drilled. This may also result in increased drilling rates but also the well to flow if the rock permeability and porosity allowed sufficient fluids to enter the well-bore.

In this drilling environment it is general practice to provide a variety of blowout preventers to control any loss of control incidents or blowouts that may occur.

A variety of techniques have been utilized for underbalanced or dual gradient drilling. Generally, they involve providing a density lowering component to the returning drilling mud. Gases, seawater, and glass beads have been injected into the returning mud flow to reduce its density.

In deep subsea applications, a number of problems may arise. Because of the pressures involved, everything becomes significantly more complicated. The pressure that bears down on the formation includes the weight of the drilling mud, whereas the pressure in the shallow formations is dictated by the weight of seawater above the formation. Because of the higher pressures involved, the drilling mud may actually be injected into the formation, fracture it and may even clog or otherwise foul the formation itself, severely impairing potential hydrocarbon production.

DETAILED DESCRIPTION

In some embodiments of the present invention, both drilling and production of fluids from a formation may occur in an underbalanced condition. As used herein, "underbalanced" means that the weight of the drilling mud is less than the pore pressure of the formation. As used herein, "dual gradient" refers to the fact that the density of fluid, at some point along its course, moving away from a drill bit, is lower than the density of the fluid moving towards the drill bit. Dual gradient techniques may be used to implement underbalanced drilling. The creation of a dual-gradient or underbalanced condition may be implemented using any known techniques, including the injection of gases, seawater, and glass beads, to mention a few examples.

Figure 1:
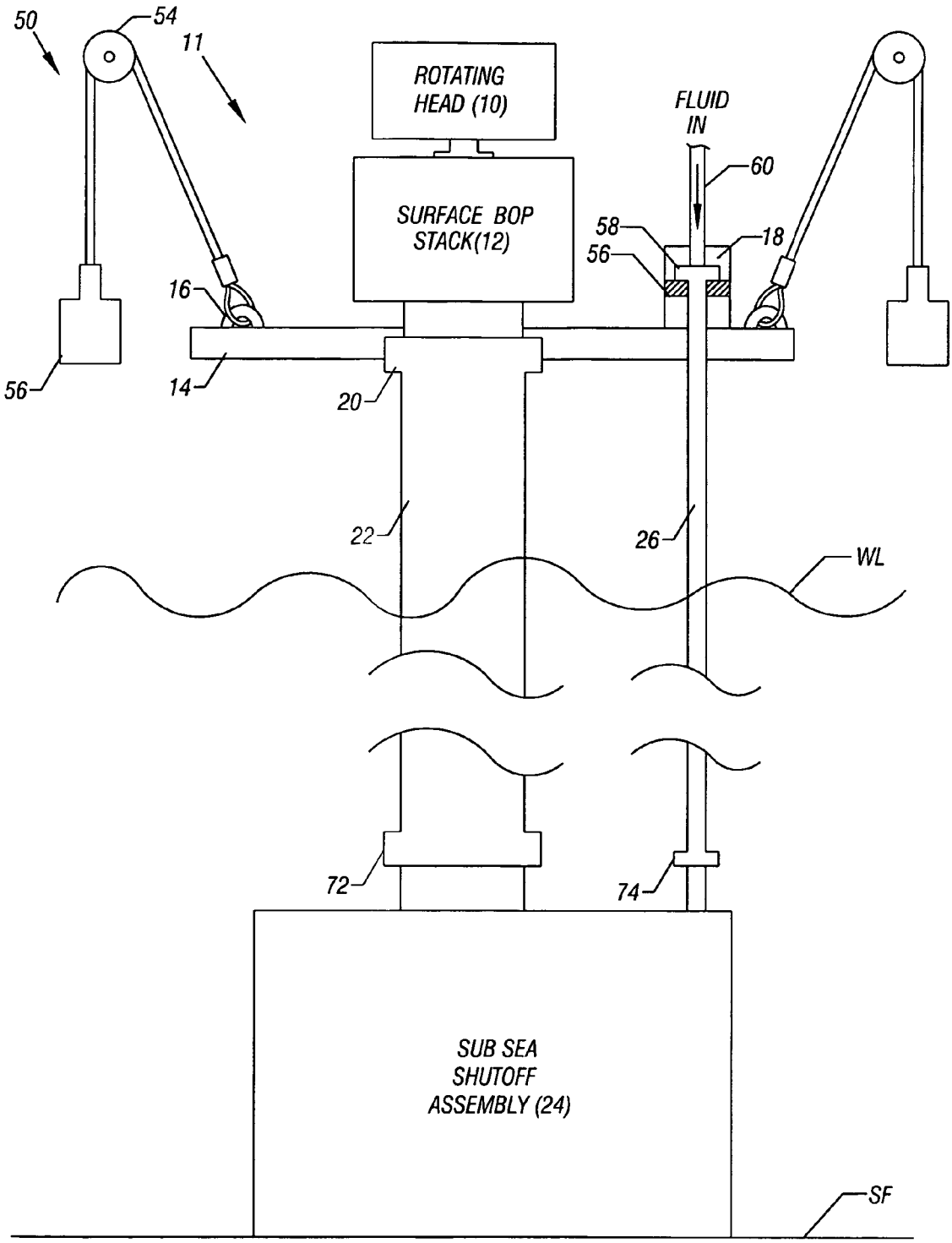
FIG. 1 is a schematic depiction of one embodiment of the present invention.

Referring to FIG. 1, a drilling and production apparatus 11 may include a rotating head 10 which rotates a string for purposes of drilling a well in a subsea formation SF. The rotating head 10 rotates the string through a surface blowout preventer (BOP) stack 12. The surface blowout preventer stack 12 may include annular blowout preventers that control the flow of fluid moving upwardly from the wellhead to the overlying floating rig 14.

The rig 14 may be tensioned using ring tensioners 16, coupled by a pulleys 54 to hydraulic cylinders 56 to create a tensioning system 50. The tensioning system 50 allows the upper portion of the apparatus 11 to move relative to the lower portion, for example in response to sea conditions. The system 50 allows this relative movement and adjustment of relative positioning while maintaining tension on the casing 22, which extends from the floating rig 14 downwardly to a subsea shutoff assembly 24.

The surface portion of the apparatus 11 is coupled by a connector 20 to the casing 22. The casing 22 is connected to the lower section of the apparatus 11 via a disconnectable latch 72 located below the sea level WL. The latch 72 may be hydraulically operated from the surface to disconnect the upper portion of the apparatus 11 from the lower portion including the subsea shutoff assembly 24.

Also provided on the rig 14 is a source of fluid that is of a lower density than the density of mud pumped downwardly through the casing 22 from the surface in one embodiment of the present invention. The lower density fluid may be provided through the tubing 60.

A hanger system 58 includes a tensioner 58 that rests on a support 56. The hanger system 58 tensions the tensioned tubing 26 that extends all the way down to a disconnectable subsea latch 74 above the subsea shutoff assembly 24. Like the latch 72, the latch 74 may be remotely or surface operated to sever the tubing 26 from the subsea shutoff assembly 24. In one embodiment, the support 56 may include hydraulic ram devices that move like shear ram blowout preventers to grip the tubing 26.

The rate of lower density fluid flow through the tubing 26 from the surface may be controlled from the surface by remotely controllable valving in the subsea shutoff assembly 24, in one embodiment. It is advantageous to provide this lower density fluid from the surface as opposed to attempting to provide it from a subsea location, such as within the subsea shutoff assembly 24, because it is much easier to control and operate large pumps from the rig 14.

The subsea shutoff assembly 24 operates with the surface blowout preventer stack 12 to prevent blowouts. While the surface blowout preventer stack 12 controls fluid flow, the subsea shutoff assembly 24 is responsible for cutting off or severing the wellhead from the portions of the apparatus 11 thereabove, using shear rams 30*a* and 30*b* as shown in FIG.

2. Thus, the casing 22 may be coupled by connector 28*a* to the shear ram 30*a*. The shear ram 30*a* is coupled by a spool 34 with flanges 32*a* and 32*b* to the shear ram 30*b*. The shear ram 30*b* may be coupled through the flange 38 to a wellhead connector 28*b*, in turn connected to the wellhead.

Figure 2:
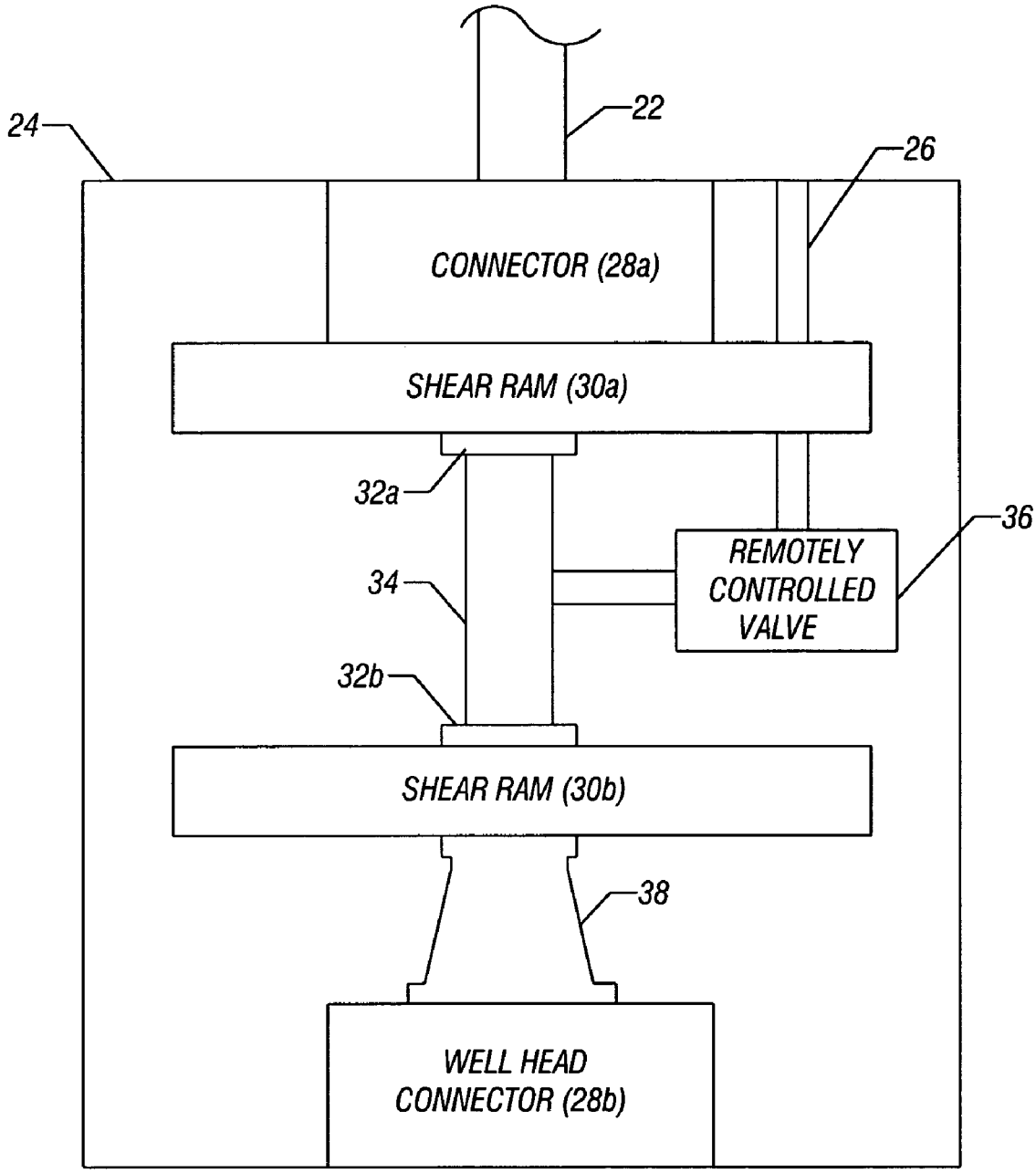
FIG. 2 is an enlarged schematic depiction of the subsea shut-off assembly shown in FIG. 1 in accordance with one embodiment of the present invention.

As shown in FIG. 2, the tubing 26 connects to a remotely controlled valve 36 that controls the rate of lower density fluid flow through the tubing 26 to the interior of the spool 34. The inlet from the tubing 26 to the spool 34 is between the two shear rams 30*a* and 30*b*.

Figure 3:
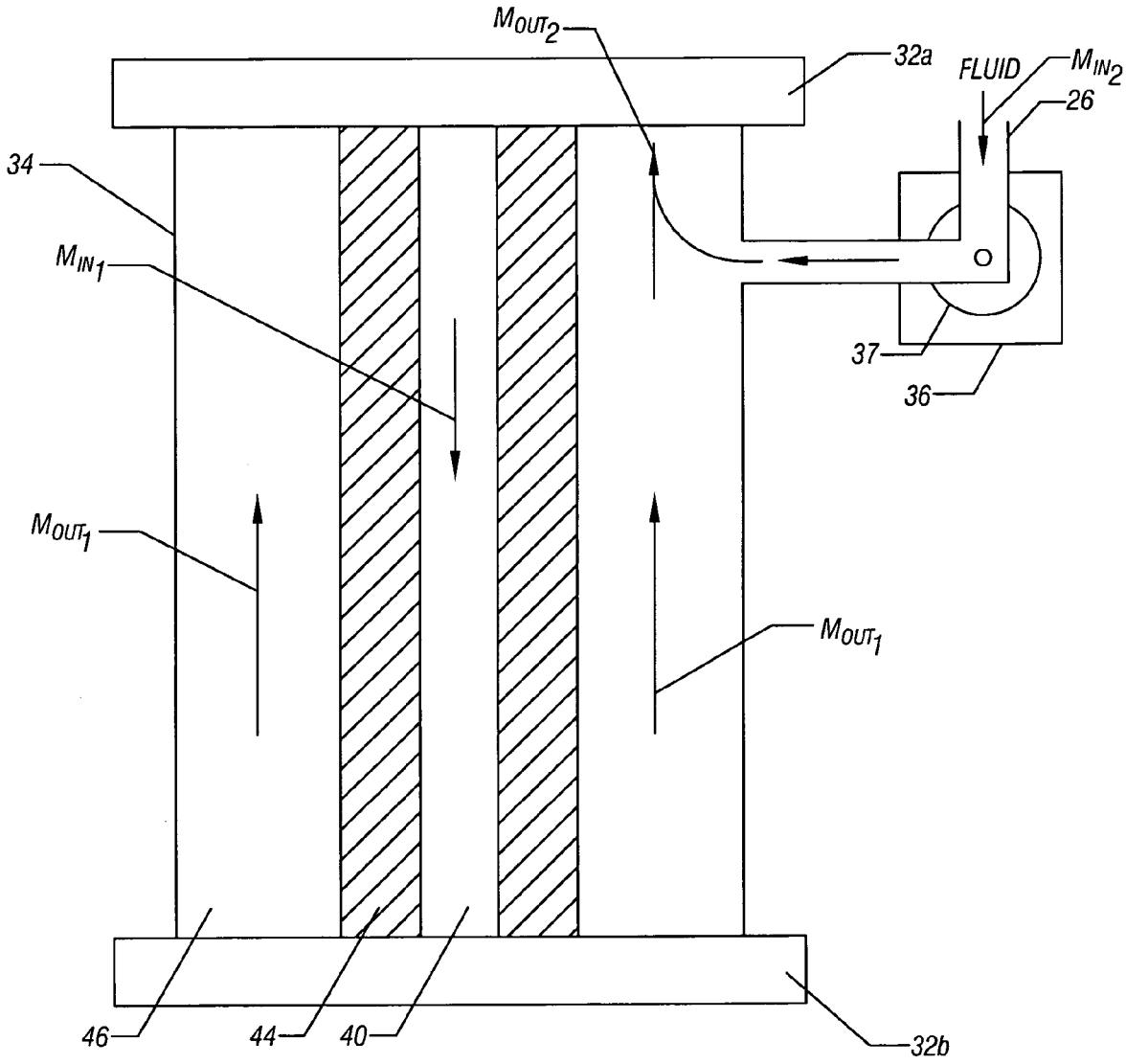
FIG. 3 is an enlarged, schematic, cross-sectional view of the spool 34 shown in FIG. 2 in accordance with one embodiment of the present invention.

The injection of lower density fluid, as shown in FIG. 3, makes use of the remotely controlled valve 36 on a spool 34. The spool 34 may have drilling mud, indicated as $M_{IN}$, moving downwardly through the casing 22. The returning mud, indicated as $M_{OUT}$, extends upwardly in the annulus 46 surrounding the string 40 and annulus 44. Thus, lower density fluid may be injected, when the valve 36 is opened, into the returning mud/hydrocarbon flow to lower its density.

An underbalanced situation may be created as a result of the dual densities of mud in one embodiment. Namely, mud above the valve 36 may be at a lower density than the density of the mud below the valve 36, as well as the density of the mud moving downwardly to the formation. The valve 36 may include a rotating element 37 that allows the valve 36 to be opened or controlled. As an additional example, the valve 36 may be a pivoted gate valve with a hydraulic fail safe that automatically closes the valve in the event of a loss of hydraulics. The valve 36 may enable the extent of underbalanced drilling to be surface or remotely controlled depending on sensed conditions, including the upward pressure supplied by the formation. For example, the valve 36 may be controlled acoustically from the surface.

Thus, in some embodiments of the present invention, flow control may be done most effectively at the surface, whereas shutoff control is done on the seafloor bed. The pumping of the lower density fluid is also done on the surface, but its injection may be done at the subsea shutoff assembly 24, in one embodiment between the shear rams 30*a* and 30*b*.

Figure 4:
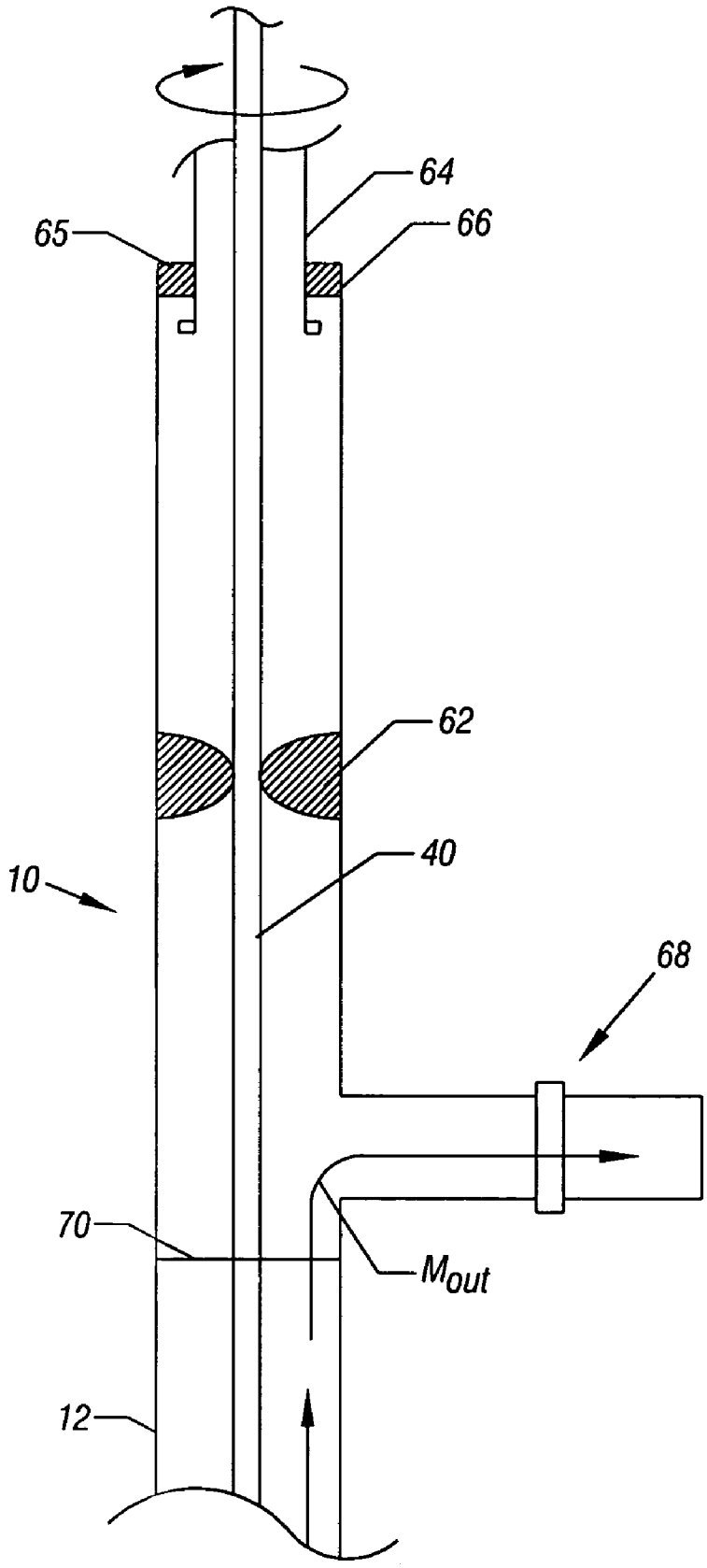
FIG. 4 is a schematic cross-sectional view of the rotating head shown in FIG. 1 in accordance with one embodiment of the present invention.

The rotating head 10, shown in more detail in FIG. 4, is coupled to the surface blowout preventer stack 12 at a joint 70. Returning fluid, indicated as $M_{OUT}$, is passed through a valve 68 to an appropriate collection area. The collection area may collect both mud with entrained debris, as well as production fluids such as hydrocarbons. The production fluids may be separated using well known techniques.

The upward flow of the fluid $M_{OUT}$ is constrained by a packer 62. In one embodiment, the packer 62 is a rubber or resilient ring that seals the annulus around the string 40 and prevents the further upward flow of the fluids. At the same time, the packer 62 enables the application of a rotating force in the direction of the circular arrow from the rotating head 66 to the string 40 for purposes of drilling. Seals 65 may be provided between a telescoping joint 64 and the rotating head 66 as both drilling and production may be accomplished in an underbalanced situation.

Thus, in some embodiments of the present invention, a subsea shutoff assembly 24 may be provided to cut off the string in the event of a failure, such as a blowout. At the same time, surface annular blowout preventers control fluid flow. Dual gradient drilling may be achieved through the provision of fluid from the surface through a side inlet into the region between the upper and lower ram type shear blowout preventers 30. Through the provision of the separate tubing 26 with a remotely operable latch 74, appropriate volumes of fluid can be achieved that would not be available with conventional kill and choke lines. The tubing 26 for providing the density control fluid may be both tensioned and latched. As a result, dual gradient production and drilling may be achieved in some embodiments of the present invention.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

coupling a surface blow out preventer to a wellhead using casing;

providing a remotely operable subsurface latch to sever the connection between said wellhead and said surface blow out preventer; and producing hydrocarbons from a subsea well in an underbalanced condition using a rotating head mounted on the surface blow out preventer.

2. The method of claim 1 including using the surface blow out preventer to provide surface flow control.

3. The method of claim 2 including providing a subsurface blow out preventer in addition to said surface blow out preventer.

4. The method of claim 3 including providing subsurface shear blow out preventers.

5. The method of claim 1 including tensioning said casing.

6. The method of claim 1 including providing a flow of mud through a casing to a drill bit.

7. The method of claim 6 including lowering the density of mud returning from said drill bit through said casing.

8. The method of claim 7 including providing a separate line to enable fluid to be pumped from the surface to a subsurface location to lower the density of the returning mud.

9. The method of claim 8 including providing a tensioned line to provide said fluid from said surface.

10. The method of claim 9 including providing a disconnectable latch to disconnect the line from the wellhead.

11. The method of claim 10 including providing a subsurface blow out preventer and providing said line to said subsurface blow out preventer.

12. The method of claim 11 including providing a pair of shear ram subsurface blow out preventers and pumping said fluid between said shear blow out preventers.

13. The method of claim 12 including providing a remotely operable valve to control the flow of said fluid and positioning said valve at a subsea location.

14. The method of claim 1 including providing a rotating head that transfers rotational energy to said drill string through a packer.

15. The method of claim 14 including providing said rotational energy through a resilient packer.

16. A drilling rig comprising:

a rotating head;

a surface blow out preventer mounted under said rotating head on said rig; and an apparatus to pump fluid to a subsea location to lower the density of drilling mud returning to said rig.

17. The rig of claim 16 including a casing coupled from said surface blow out preventer to a subsea subsurface blow out preventer.

18. The rig of claim 17 wherein said subsea blow out preventer includes a pair of shear blow out preventers.

19. The rig of claim 18 including a remotely operable latch to sever said casing from said subsea blow out preventer.

20. The rig of claim 19 wherein said casing is tensioned.

21. The rig of claim 16 including a separate line to supply lower density fluid to a subsea location to lower the density of drilling mud to be returned to said rig.

22. The rig of claim 21 wherein said line is tensioned.

23. The rig of claim 22 wherein a disconnectable latch is provided to disconnect the line at a subsea location.

24. The rig of claim 16 including a subsurface blow out preventer and a coupling to receive said line.

25. The rig of claim 24 wherein said subsurface blow out preventer includes a pair of shear ram subsurface blow out preventers and said coupling is arranged between said pair of shear ram subsurface blow out preventers.

26. The rig of claim 25 including a valve in said line to control the flow of fluid to lower the density of said drilling mud.

27. The rig of claim 16 wherein said rotating head includes a resilient packer and a drill string and tubing, said resilient packer to seal the region between said drill string and said tubing and to transfer rotational energy from said tubing to said drill string.

28. The subsea shutoff assembly comprising:

a pair of shear blow out preventers; and a device coupling said blow out preventers, said device having an inlet to receive a density lowering fluid to lower the density of drilling mud moving upwardly through said device.

29. The assembly of claim 28 including a line for supplying density lowering fluid, said line including a remotely actuatable valve.

30. The assembly of claim 29 wherein said valve automatically closes upon loss of control.

31. A method comprising:

operating a subsea wellhead in an underbalanced condition;

providing mud at a first density to said wellhead; and injecting, from the sea surface, a first density lowering fluid, into mud returning from said wellhead, through tensioned, latched tubing.

32. The method of claim 31 including producing hydrocarbons from a subsea well in an underbalanced condition using a rotating head mounted on a surface blow out preventer.

33. The method of claim 32 including using the surface blow out preventer to provide surface flow control.

34. The method of claim 33 including providing a subsurface blow out preventer in addition to said surface blow out preventer.

35. The method of claim 34 including providing subsurface shear blow out preventers.

36. The method of claim 31 including providing a separate line for said first density lowering fluid to be pumped from the surface to a subsurface location mud.

37. The method of claim 36 including providing a subsurface blow out preventer and providing said line to said subsurface blow out preventer.

38. The method of claim 37 including providing a pair of shear ram subsurface blow out preventers and injecting said first density lowering fluid between said shear blow out preventers.

39. The method of claim 38 including providing a remotely operable valve to control the flow of said fluid and positioning said valve at a subsea location.

40. The method of claim 32 including providing a rotating head that transfers rotational energy to said drill string through a packer.

41. The method of claim 40 including providing said rotational energy through a resilient packer.

42. A system for supplying density lowering fluid to a subsea location comprising:

a surface hanger to tension and hang tubing connectable to a source of density lowering fluid; and a subsea latch to couple a first portion of said tubing to a second portion of said tubing, said latch being remotely operable to disconnect said first portion of said tubing from said second portion of said tubing.

43. The system of claim 42 including a subsea valve to control the rate of flow of fluid through said tubing.

44. The system of claim 43 wherein said valve is coupled to a connector to couple said tubing to a subsea location.

45. The system of claim 42 including a subsea shutoff assembly coupled to said tubing.

46. The system of claim 45 wherein said subsea shutoff assembly includes a pair of shear ram blow out preventers coupled to one another.

47. The system of claim 46 including a coupling to connect said shear ram blow out preventers to one another, said coupling adapted to receive said tubing, said coupling to pass drilling fluid downwardly through a central passage and upwardly through a radially displaced passage.

48. The system of claim 42 wherein said latch disconnects upon detection of a failure.

49. The system of claim 42 wherein said hanger includes a hydraulic ram to grip said tubing.

50. A method comprising:

providing a rotating head that transfers rotational energy to said drill string through a packer; and producing hydrocarbons from a subsea well in an underbalanced condition using the rotating head mounted on the surface blow out preventer.

51. The method of claim 50 including providing said rotational energy through a resilient packer.

* * * * *